US005573881A

United States Patent [19]

Kawasaki et al.

[11] Patent Number: 5,573,881

[45] Date of Patent: Nov. 12, 1996

[54] TONER COMPOSITION FOR ELECTROPHOTOGRAPHY

[75] Inventors: Shoji Kawasaki; Nobuhiro Hirayama; Kenji Uchiyama; Hisatomo Sato; Hiromi Akiyama; Katuo Uramoto, all of Kanagawa, Japan

[73] Assignee: Mitsui Toatsu Chemicals, Inc., Tokyo, Japan

[21] Appl. No.: 476,042

[22] Filed: Jun. 7, 1995

Related U.S. Application Data

[63] Continuation of Ser. No. 105,652, Aug. 13, 1993, abandoned, which is a continuation of Ser. No. 717,010, Jun. 18, 1991, abandoned.

[30] Foreign Application Priority Data

Jun. 25, 1990 [JP] Japan ..... 2-164032
Jun. 25, 1990 [JP] Japan ..... 2-164033

[51] Int. Cl.[6] ..... G03G 9/00

[52] U.S. Cl. ..... 430/110; 430/97; 430/137

[58] Field of Search ..... 430/110, 97, 137

[56] References Cited

U.S. PATENT DOCUMENTS

| | | | |
|---|---|---|---|
| 3,965,022 | 6/1976 | Strong et al. | 252/62.1 P |
| 4,262,077 | 4/1981 | Ito | 430/110 |
| 5,135,833 | 8/1992 | Matsunaga et al. | 430/110 |

FOREIGN PATENT DOCUMENTS

| | | |
|---|---|---|
| 48-75033 | 10/1973 | Japan . |
| 49-101031 | 9/1974 | Japan . |
| 55-6895 | 2/1980 | Japan . |
| 55-88071 | 7/1980 | Japan . |
| 55-88073 | 7/1980 | Japan . |
| 55-90958 | 7/1980 | Japan . |
| 55-153944 | 12/1980 | Japan . |
| 57-211157 | 12/1982 | Japan . |

OTHER PUBLICATIONS

Patent Abstracts of Japan, vol. 7, No. 113 (P–197)[1258], 18 May 1983 & JP–A–58 33 263.

Patent Abstracts of Japan, vol. 12, No. 266 (P–735)[3113], 26 Jul. 1988; & JP–A–63 50 858.

Patent Abstracts of Japan, vol. 10, No. 177 (P–470)[2233], 21 Jun. 1986; & JP–A–61 26 058.

Database WPIL, No. 86–077822, Derwent Publications Ltd., London, GB.

*Primary Examiner*—Mark Chapman

*Attorney, Agent, or Firm*—Burns, Doane, Swecker & Mathis

[57] ABSTRACT

A toner composition for electrophotography comprises at least a binder, a coloring agent and optionally a low molecular weight wax in an amount ranging from 0.5 to 20 parts by weight per 100 parts by weight of the binder as essential components wherein the binder comprises, as a principal component, a resin mixture prepared by heating a resin solution comprising a styrene resin and a block copolymer which comprises blocks derived from at least one member selected from ethylenic hydrocarbons and conjugated diene hydrocarbons and blocks derived from styrene and/or a hydrogenated product thereof in an amount ranging from 0.1 to 20 parts by weight per 100 parts by weight of the styrene resin to remove the solvent. The low molecular weight wax may be included in the binder.

13 Claims, No Drawings

TONER COMPOSITION FOR ELECTROPHOTOGRAPHY

This application is a continuation, of application Ser. No. 08/105,652, filed Aug. 13, 1993 now abandoned, which is a continuation of application Ser. No. 07/717,010, filed Jun. 18, 1991 now abandoned.

BACKGROUND OF THE INVENTION

1. Field of the Invention

The present invention relates to a toner composition for electrophotography. More specifically, the present invention relates to a toner composition for electrophotography which is excellent in fixing ability, resistance to offset and image-forming properties.

2. Description of the Prior Art

In the field of the electrophotography, there have recently been developed a variety of copying apparatuses which make use of various fixing processes and a fixing process which has recently been most commonly used is the heat fusing-roll process. It has recently been required to greatly increase copying speed along with handling an increase in the quantity of information to be processed. In a high speed copying apparatus whose process speed exceeds 340 mm/s, the heat of the heat fusing-roll is transferred to copying paper in only a small quantity per unit area of the copying paper, while the paper takes a large quantity of heat away from the heat fusing-roll which leads to an increase in the heat loss. For this reason, the surface temperature of the heat fusing-roll is markedly decreased.

On the other hand, as household copying apparatuses and printers of electrophotographic systems are widely used, the size of the copying apparatus has been made more and more compact and the temperature as well as pressure of the heat fusing-roll has gradually been lowered or reduced.

As a result of the foregoing speeding up and miniaturization of the copying apparatuses, the conventional toners cannot be made sufficiently molten by the heat from the heat fusing-roll and, therefore, the conventional toners suffer from a problem such that they exhibit only insufficient fixing ability.

It may be thought that the foregoing problem can be solved by reducing the molecular weight of a resin used as a binder and hence the viscosity of the resulting toner in its molten state to thus improve the flow properties and hence the fixing ability of the toner. However, this becomes a cause of another problem that the toner tends to adhere to the surface of the heat fusing-roll and the adhered toner is again transfered to the subsequent copying paper (so-called offset phenomenon). Moreover, the strength of the binder is lowered because of the low molecular weight of the resin used. More specifically, images thermally fixed on the paper are damaged through bending and rubbing of the paper and as a result, the toner adhered to the paper drops off to thus cause defects of the images. Therefore, this method does not provide a toner having excellent fixing ability.

Under such circumstances, there has long been desired for the development of a toner composition which can be fixed at a low temperature, has high resistance to mechanical breakage and does not cause any offset phenomenon.

For instance, Japanese Examined Patent Publication (hereinafter referred to as "J.P. KOKOKU") No. Sho 55-6895 discloses a method for preparing a toner composition as a developer having good resistance to offset. The method employs, as a binder, a resin having a ratio of weight-average molecular weight to number-average molecular weight ranging from 3.5 to 40 and a number-average molecular weight ranging from 2,000 to 30,000. Further, Japanese Unexamined Patent Publication (hereinafter referred to as "J.P. KOKAI") No. Sho 49-101031 discloses a method for preparing a toner composition which does not cause offset phenomenon at all even at a relatively high fixing temperature in which a crosslinked resin is used as a binder to thus broaden the range of fixing temperature of the resulting toner.

However, these methods do not achieve a sufficient effect of inhibiting the offset phenomenon in high speed and small-sized copying apparatuses in which it is hard to transfer sufficient heat from the heat fusing-rollers to copying paper. In other words, if resins having a high weight-average molecular weight or those crosslinked are used as binders in order to prevent the offset phenomenon, the fixing ability of the resulting toner is impaired because of the high viscosity of the resin. On the contrary, if resins having a low weight-average molecular weight or those free of crosslinks are used as binders and hence the viscosity of the resin used is reduced, the images thermally fixed onto paper are broken upon bending or rubbing the paper and as a result, the toner adhered to the paper drops off to thus cause defects of the images and the offset phenomenon. Thus, the quality of images would be substantially impaired.

As a further means for solving the foregoing problems, J.P. KOKAI No. Sho 48-75033 proposes pressure-sensitive deformable pressure-fixable toner which comprises, for instance, a block copolymer comprising a combination of a hard resin and a soft resin. However, when such a block copolymer is used alone, the offset phenomenon arises and thus it cannot be used as a toner for heat fusing. In addition, the pulverization of the block copolymer is substantially difficult if it is pulverized by the existing conventional kneading and pulverization method. This results in an extreme reduction in yield of toners.

Further, J.P. KOKAI Nos. Sho 55-88071, Sho 55-88073 and Sho 55-90958 disclose magnetic toners excellent in resistance to offset and fixing ability which are obtained by melting and kneading a mixture containing, for instance, a styrene resin, a ternary block copolymer of styrene-butadiene-styrene, a releasing agent such as polybutene, polybutadiene, chlorinated paraffin, polystyrene, polyethylene and polypropylene, magnetic powder and carbon black. However, it has been confirmed that it is difficult to uniformly disperse, in the styrene resin, the ternary block copolymer, the releasing agent and an agent for adjusting electrification through melting and kneading thereof for a short period of time and that contamination of a light-sensitive material is liable to cause due to filming of the light-sensitive material. Moreover, when a large amount of the styrene-butadiene-styrene is used, the ingredient cannot be subjected to conventional pulverization, for instance, pulverization by a jet mill after kneading and must be pulverized while freezing or cooling the ingredients.

SUMMARY OF THE INVENTION

The inventors of this invention have conducted various studies to develop a toner composition whose ingredients can be pulverized to give toners in high yield, which can be fixed to paper, as a toner for heat fusing, at a low quantity of heat irrespective of the kinds of the toner, i.e., whether it is magnetic or non-magnetic; or one-component or two-component system, which does not cause any offset phenomenon and which can solve all of the problems of offset phenomenon observed when a pressure-fixing toner consisting of a block copolymer of a hard resin and a soft resin is employed alone as that for heat fusing, of deterioration of the quality of images due to the contamination of a light-sensitive material which is observed in a magnetic toner comprising a large amount of a ternary block copolymer of polystyrene-polybutadiene-polystyrene because of the insufficient dispersion of the ternary block copolymer, a releasing agent and a charge control agent in a styrene resin, and of requiring of pulverization under cooling such as freeze-pulverization. As a result, it has been found that if a solvent having good compatibility with both a block copolymer comprising blocks of at least one member selected from ethylenic hydrocarbons and conjugated diene hydrocarbons and blocks derived from styrene and/or hydrogenated products thereof and a styrene resin is selected and employed and then the solvent is removed after the components are uniformly dissolved and mixed, the block copolymer and/or the hydrogenated products thereof can be uniformly dispersed in the styrene resin, there can be solved the problem of insufficient dispersion observed in the conventional techniques during mixing and kneading the components and a toner having excellent fixing ability can be obtained even if the amount of the block copolymer and/or the hydrogenated products thereof to be used is substantially reduced. Further, the pulverization properties of the ingredients can be improved and a toner can be obtained through conventional pulverization in high yield since the amount of the block copolymer and/or the hydrogenated products thereof to be used can thus be reduced. Moreover, it has also been found that the dispersibility of a low molecular weight wax in the resin mixture obtained by such a method is unexpectedly improved. For this reason, the low temperature fixing properties and the resistance to offset of the resulting toner can further be improved.

Furthermore, it is preferred that if the foregoing block copolymer and/or the hydrogenated products thereof are used, a block copolymer previously hydrogenated or a block copolymer free of unsaturated bonds is used since the block copolymers carrying unsaturated bonds are easily thermally deteriorated.

Accordingly, the present invention relates to a toner composition for electrophotography which comprises, as essential components, at least a binder and a coloring material wherein the binder comprises, as a principal component, a resin mixture obtained by heating a solution containing a styrene resin and a block copolymer comprising blocks of at least one member selected from ethylenic hydrocarbons and conjugated diene hydrocarbons and blocks derived from styrene and/or hydrogenated products thereof in an amount ranging from 0.1 to 20 parts by weight per 100 parts by weight of the styrene resin to thus remove the solvent.

According to another aspect of the present invention, there is provided a toner composition for electrophotography which comprises, as essential components, at least a binder, a coloring material and a low molecular weight wax in an amount ranging from 0.5 to 20 parts by weight per 100 parts by weight of the binder wherein the binder comprises, as a principal component, a resin mixture obtained by heating a solution containing a styrene resin and a block copolymer comprising blocks of at least one member selected from ethylenic hydrocarbons and conjugated diene hydrocarbons and blocks derived from styrene and/or hydrogenated products thereof in an amount ranging from 0.1 to 20 parts by weight per 100 parts by weight of the styrene resin to thus remove the solvent.

According to a further aspect of the present invention, there is provided a toner composition for electrophotography which comprises, as essential components, at least a binder and a coloring material wherein the binder comprises, as a principal component, a resin mixture obtained by heating a solution containing a styrene resin, a block copolymer comprising blocks of at least one member selected from ethylenic hydrocarbons and conjugated diene hydrocarbons and blocks derived from styrene and/or hydrogenated products thereof in an amount ranging from 0.1 to 20 parts by weight per 100 parts by weight of the styrene resin and a low molecular weight wax in an amount ranging from 0.5 to 20 parts by weight per 100 parts by weight of the binder to thus remove the solvent.

DESCRIPTION OF THE PREFERRED EMBODIMENTS

The styrene resins used in the present invention as binders are homopolymers of styrene or copolymers of styrene and an ethylenically unsaturated monomer as will be detailed below obtained through a variety of polymerization methods such as solution polymerization, suspension polymerization and emulsion polymerization. These styrene resins can be used alone or as a mixture of two or more of them. The molecular weight of the styrene resins preferably ranges from 10,000 to 300,000 expressed in terms of weight-average molecular weight (Mw). This is because, if the Mw of the resin is less than 10,000, the flow properties of the resulting toner are improved, while a problem of the resin strength of the resulting toner arises. On the other hand, if it exceeds 300,000, the flow properties of the toner are substantially impaired and hence the toner is not favorable for use in high speed copying apparatuses and copying apparatuses operated at a low quantity of heat.

Specific examples of the foregoing ethylenically unsaturated monomers copolymerizable with styrene include acrylates such as methyl acrylate, ethyl acrylate, propyl acrylate, butyl acrylate, octyl acrylate, cyclohexyl acrylate, lauryl acrylate, stearyl acrylate, benzyl acrylate, furfuryl acrylate, tetrahydrofurfuryl acrylate, hydroxyethyl acrylate, hydroxybutyl acrylate, dimethylaminomethyl acrylate and dimethylaminoethyl acrylate; methacrylates such as methyl methacrylate, ethyl methacrylate, propyl methacrylate, butyl methacrylate, octyl methacrylate, lauryl methacrylate, stearyl methacrylate, cyclohexyl methacrylate, benzyl methacrylate, furfuryl methacrylate, tetrahydrofurfuryl methacrylate, hydroxyethyl methacrylate, hydroxypropyl methacrylate, hydroxybutyl methacrylate, dimethylaminomethyl methacrylate and dimethylaminoethyl methacrylate; aromatic vinyl monomers such as vinyl toluene, α-methylstyrene and chlorostyrene; dialkyl esters of dibasic acids such as dibutyl maleate, dioctyl maleate, dibutyl fumarate and dioctyl fumarate; vinyl esters such as vinyl acetate and vinyl propionate; nitrogen atom-containing vinyl monomers such as acrylonitrile and methacrylonitrile; unsaturated carboxylic acids such as acrylic acid, methacrylic acid and cinnamic acid; unsaturated dicarboxylic acids such as maleic acid, maleic anhydride, fumaric acid and itaconic acid; unsaturated dicarboxylic acid monoesters such as monomethyl maleate, monoethyl maleate, monobutyl maleate, monooctyl maleate, monomethyl fumarate, monoethyl fumarate, monobutyl fumarate and monooctyl fumarate; styrene-sulfonic acid, acrylamide, methacrylamide, N-substituted acrylamides, N-substituted methacrylamides and acrylamidopropanesulfonic acid. These monomers can be used alone or in combination. Among these, particularly preferred are, for instance, acrylic acid esters, methacrylic acid esters, α-methylstyrene, dialkyl fumarates, acrylonitrile, methacrylic acid, cinnamic acid, fumaric acid monoesters, acrylic acid, acrylamide and methacrylamide.

The block copolymers comprising blocks derived from at least one member selected from ethylenic hydrocarbons and conjugated diene hydrocarbons and blocks derived from styrene and/or hydrogenated products thereof (hereinafter simply referred to as "block copolymers") which are used as the other component of the binder can be prepared by, for instance, polymerizing at least one member selected from the group consisting of ethylenic hydrocarbons such as ethylene, propylene, 1-butene, 2-butene, isobutylene, 1-pentene, 2-pentene, 2-methyl-1-butene, 3-methyl-1-butene, 2-methyl-2-butene, 1-hexene and 2,3-dimethyl-2-butene and conjugated diene hydrocarbons such as butadiene and isoprene through the known living anion polymerization or living cation polymerization to form a block polymer and then subjecting the block polymer to block copolymerization with styrene while making use of the reactive groups at the ends of the block polymer. However, the method for preparing the block copolymer is not restricted to specific ones and any commonly known method can be adopted.

Further, the foregoing block copolymers can also be used in the form of hydrogenated products obtained through hydrogenation thereof according to the usual manner.

In particular, it is preferred, in the present invention, to use block copolymers which have previously been hydrogenated or those free of unsaturated bonds since the block copolymers carrying unsaturated bonds are liable to cause thermal deterioration during heating for removing solvents or during melting and kneading process in the preparation of toners. More specifically, preferred examples of such block copolymers are those obtained from the ethylenic hydrocarbons such as ethylene and propylene which do not introduce any unsaturated bond into the resulting copolymer or those free of unsaturated bonds obtained by hydrogenating block copolymers carrying unsaturated bonds.

As such block copolymers, those commercially available may be used in the present invention. Specific examples thereof are Cariflex TR and Kraton (styrene-butadiene-styrene, styrene-isoprene-styrene, styrene-ethylene/butylene-styrene block copolymers) available from Shell Kagaku K.K.; Septon (styrene-ethylene/propylene or styrene-isoprene hydrogenated block copolymer) available from Kuraray Co., Ltd.; and Tufprene (styrene-butadiene block copolymer) available from Asahi Chemical Industry Co., Ltd.

The amount of these block copolymers to be used suitably ranges from 0.1 to 20 parts by weight and preferably 0.1 to 10 parts by weight per 100 parts by weight of the styrene resin. If the amount thereof used is less than 0.1 part by weight, the desired effect of the addition of the block copolymers cannot be anticipated at all, while if it exceeds 20 parts by weight, fixing rolls or photo-sensitive materials are severely contaminated. This is probably due to an increase in the rate of the block copolymer as a soft component. The styrene content of the block copolymer is not critical, but preferably ranges from 3 to 90% by weight and in particular 5 to 70% by weight. This is because if the styrene content of the block copolymer is less than 3% by weight, fixing rolls and/or light-sensitive materials are liable to be contaminated. On the other hand, if it is used in an amount of more than 90% by weight, significant improvement in the resin strength of the resulting toner is not expected.

In the present invention, a solution of the foregoing styrene resin and block copolymer is first formed and then the solvent is removed from the solution by heating to thus give a resin mixture. In this respect, the foregoing resin solution may be obtained by dissolving the block copolymer in a styrene resin solution obtained through the solution polymerization of the styrene resin or by dissolving the styrene resin obtained by another method and the block copolymer in a common solvent. The method for removing the solvent by heating to give the resin mixture is not likewise not restricted to a specific one, but this process is preferably performed at a temperature such that the resins are not deteriorated and that the removal of the solvent can be ensured. Specific examples of the solvent usable in the present invention include those commonly known such as benzene, toluene, xylene, ethylbenzene, Solvesso Nos. 100 and 150, mineral spirit, n-butyl alcohol, sec-butyl alcohol, iso-butyl alcohol, amyl alcohol, cyclohexyl alcohol, methyl ethyl ketone, methylisobutyl alcohol, cyclohexanone, ethyl acetate and butyl acetate. Particularly preferred are benzene, toluene, xylene, ethylbenzene and Solvesso Nos. 100 and 150. The removal of the solvent is in general performed at a temperature ranging from 100° to 250° C. and a pressure ranging from 0 to 200 mm Hg.

In addition, if it is necessary to further improve the fixing ability at a low temperature and the resistance to offset of the toner composition comprising the foregoing resin mixture, a low molecular weight wax may be used simultaneously.

Examples of such low molecular weight wax which may be used simultaneously include higher fatty acid amides, polyolefins and rosin having a softening point ranging from 60° to 180° C. In particular, it is preferred to use polyolefins having a softening point ranging from 60° to 180° C. and preferably 80° to 160° C.

Specific examples of such polyolefins include polyethylene, polypropylene, polybutylene or modified products thereof with polypropylene being particularly preferred. The amount of the low molecular weight wax used preferably ranges from 0.5 to 20 parts by weight and in particular 0.5 to 10 parts by weight per 100 parts by weight of the binder. This is because, if the amount of the wax is less than 0.5 part by weight, a desired effect of the wax is not anticipated, while if it exceeds 20 parts by weight, the level of electrification is greatly affected and as a result, the images obtained after copying operations become unclear.

When a low molecular weight wax is simultaneously used, the wax may be added in any stage, for instance, during or after the production of the resin mixture or during the production of a toner composition.

1) When the wax is added to the resin mixture during the production thereof, a desired amount of the wax is added to a resin solution obtained after the production of the styrene resin or that obtained after the production of the block copolymer, then these resin solutions are mixed and the solvent is removed by heating to thus give a resin mixture containing the wax which is subsequently used for the preparation of a desired toner composition.

2) When a low molecular weight wax is used after the production of a resin mixture, a desired amount of the wax is added to a mixture of a styrene resin and a block copolymer, then a solution of these three components is prepared and the solvent is then removed by heating to give a mixture which is subsequently used for the production of a toner composition.

3) When a low molecular weight wax is added during the production of a toner composition for electrophotography, a desired amount of the wax is added to an additive required for the production of the toner composition such as coloring agents and the additive containing the wax is added to a resin mixture obtained from a resin solution of a styrene resin and a block copolymer to give a desired toner composition.

The toner composition for electrophotography may optionally comprise, in addition to the foregoing resin mixture as the binder and the low molecular weight wax as an optional component, other additives such as polyvinyl chloride, polyolefin, polyester, polyvinyl butyral, polyurethane, polyamide, rosin, terpene resin, phenol resin, epoxy resin and/or paraffin wax.

Moreover, as the coloring agents preferably used in the toner composition for electrophotography which comprises the resin mixture and the optional low molecular weight wax according to the present invention, there may be used, for instance, black pigments such as carbon black, acetylene black and lamp black; and known inorganic and organic pigments such as chrome yellow, yellow iron oxide, Hansa Yellow, Quinoline Yellow Lake, Permanent Yellow NCG, Molybdenum Orange, Vulcan Orange, indanthrene, Brilliant Orange GK, red iron oxide, Brilliant Orange Carmine 6B, Methyl Violet Lake, Fast Violet B, Cobalt Blue, Alkali Blue Lake, Phthalocyanine Blue, Fast Sky Blue, Pigment Green B, Malachite Green Lake, titanium oxide and zinc white. The amount of these coloring agents ranges from 5 to 300 parts by weight per 100 parts by weight of the foregoing resin mixture.

In addition to the foregoing components, the toner composition of the present invention may further comprise properly and arbitrarily selected combination of other additives, for instance, known agents for adjusting electrification, pigment dispersants and agents for inhibiting offset such as Nigrosine, quaternary ammonium salts, metal-containing azo dyes and metal salts of fatty acids. The foregoing components can be treated in accordance with any known method to give the toner composition of the present invention.

More specifically, the toner composition which comprises the aforementioned various additives is subjected to premixing using a Henschel mixer, then kneaded in a kneading machine such as a kneader while heating the composition to melt the same, cooled, finely pulverized with a jet pulverizer, classified with a classifying machine to collect particles in general having a particle size ranging from 8 to 20 μ to hence give a desired toner composition.

The present invention will hereinafter be explained in more detail with reference to the following Preparation Examples and Examples, but the present invention is by no means limited to these specific Examples. In the following description, the term "part" means "part by weight" unless otherwise specified.

Preparation Examples of Styrene Resins

Preparation Example 1

To a 5 l volume, 4-necked flask equipped with a condenser, a thermometer, a nitrogen gas-introducing tube and a stirring machine, there were charged 70 parts of styrene and 30 parts of n-butyl acrylate, the temperature of the flask was raised up to 100° C. while introducing nitrogen gas into the flask and then 60 parts of xylol and 0.2 part of azoisobutyronitrile were continuously dropwise added to the contents of the flask over 10 hours. Then the temperature was raised up to 130° C. to perform polymerization of the remaining monomers for 5 hours. The solvent was removed from the resulting resin solution to give a styrene resin A having a weight-average molecular weight of 202,000.

Preparation Example 2

To a 5 l volume, 4-necked flask equipped with a condenser, a thermometer, a nitrogen gas-introducing tube and a stirring machine, there were charged 40 parts of styrene, 25 parts of acrylonitrile and 35 parts of n-butyl acrylate, the temperature of the flask was raised up to 100° C. while introducing nitrogen gas into the flask and then 60 parts of xylol and 0.2 part of azoisobutyronitrile were continuously dropwise added to the contents of the flask over 10 hours. Then the temperature was raised up to 130° C. to perform polymerization of the remaining monomers over 5 hours. The solvent was removed from the resulting resin solution to give a styrene resin B having a weight-average molecular weight of 253,000.

Preparation Example 3

To a 5 l volume, 4-necked flask equipped with a condenser, a thermometer, a nitrogen gas-introducing tube and a stirring machine, there were charged 100 parts of distilled water and 0.5 part of polyvinyl alcohol and then a solution containing 80 parts of styrene, 20 parts of 2-ethylhexyl acrylate and 2 parts of benzoyl peroxide was introduced into the flask at 250 rpm and 85° C. while introducing nitrogen gas into the flask to perform polymerization over 6 hours. The resulting product was cooled, washed with water and dried for 20 hours with a hot-air dryer to thus give a styrene resin C having a weight-average molecular weight of 151,000.

Preparation Example 4

The same procedures used in Preparation Example 1 were repeated except that 6 parts of azoisobutyronitrile was used to give a styrene resin D having a weight-average molecular weight of 8,000.

Preparation Example 5

The same procedures used in preparation Example 1 were repeated except that 0.12 part of azoisobutyronitrile was used to give a styrene resin E having a weight-average molecular weight of 324,000.

Preparation Examples of Block Copolymers

Preparation Example 6

To an autoclave through which an inert gas had been passed to displace the air, there were added 100 parts of heptane, 0.2 part of ethylene chloride and 0.5 part of triethylaluminum and ethylene and propylene (1:1) were copolymerized at 43° C. and 0.5 atm. for 2 hours. The resulting copolymerization solution was filtered, the resin was washed and again suspended in 100 parts of heptane. Further, 0.5 part of a peroxide and 5 parts of styrene were added to the suspension and polymerized at 43° C. for 10 hours. The resulting resin solution was filtered, the resulting precipitates were washed and then the solvent was removed to give a block copolymer a.

Preparation Example 7

The same procedures used in Preparation Example 6 were repeated except that 10 parts of styrene was used to give a block copolymer b.

Preparation Example 8

The same procedures used in Preparation Example 6 were repeated except that 50 parts of styrene was used to give a block copolymer c.

Preparation Example 9

The same procedures used in Preparation Example 6 were repeated except that 100 parts of styrene was used to give a block copolymer d.

Preparation Example 10

The same procedures used in Preparation Example 6 were repeated except that 150 parts of styrene was used to give a block copolymer e.

Preparation Example 11

The same procedures used in Preparation Example 6 were repeated except that 350 parts of styrene was used to give a block copolymer f.

Preparation Example 12

The same procedures used in Preparation Example 6 were repeated except that 2-butene and butadiene (1:1) were substituted for the ethylene and propylene used in Preparation Example 6 to give a block copolymer g.

Preparation Example 13

The same procedures used in Preparation Example 7 were repeated except that 2-butene and butadiene (1:1) were substituted for the ethylene and propylene used in Preparation Example 7 to give a block copolymer h.

Preparation Example 14

The same procedures used in Preparation Example 8 were repeated except that 2-butene and butadiene (1:1) were substituted for the ethylene and propylene used in Preparation Example 8 to give a block copolymer i.

Preparation Example 15

The same procedures used in Preparation Example 9 were repeated except that 2-butene and butadiene (1:1) were substituted for the ethylene and propylene used in Preparation Example 9 to give a block copolymer j.

Preparation Example 16

The same procedures used in Preparation Example 10 were repeated except that 2-butene and butadiene (1:1) were substituted for the ethylene and propylene used in Preparation Example 10 to give a block copolymer k.

Preparation Example 17

The same procedures used in Preparation Example 11 were repeated except that 2-butene and butadiene (1:1) were substituted for the ethylene and propylene used in Preparation Example 11 to give a block copolymer l.

The block copolymers thus prepared were subjected to the analysis of styrene content by pyrolysis gas chromatography. The results thus obtained are summarized in the following Table 1.

TABLE 1

Styrene Content of Block Copolymer

| Block Copolymer | Styrene Content (%) |
|---|---|
| a | 3.0 |
| b | 5.0 |
| c | 24.6 |
| d | 48.1 |
| e | 70.0 |
| f | 90.0 |
| g | 3.4 |
| h | 5.8 |
| i | 23.9 |
| j | 46.0 |
| k | 70.1 |
| l | 89.0 |

In the following description, the fixing ability, offset properties and quality of images were evaluated according to the following methods. Incidentally, the fixing ability and offset properties were determined using a commercially available copying apparatus which had been reconstructed so that the roll temperature could be arbitrarily changed.

(1) 70% Fixing Temperature: This means the lowest roll temperature required for remaining 70% by weight or more of the toner layer as determined at a process speed of 340 mm/sec after rubbing a 2 cm×2 cm solid portion on an image 50 times under a load of 125 g/cm$^2$ with a sand eraser using Gakushin Model Tester for fastness to rubbing (available from Daiei Kagaku Seiki K.K.).

(2) Offset Temperature: This means the temperature at which the offset phenomenon was initiated when the copying operation was performed at a process speed of 340 mm/sec, while the temperature of the thermal roll was gradually increased.

(3) Higher Offset Temperature: This means a temperature at which the offset phenomenon was initiated when the copying operation was performed at a process speed of 100 mm/sec, while the temperature of the thermal roll was gradually increased.

(4) Evaluation of Quality of Images: This was visually estimated on the basis of the following evaluation criteria:

⊙: Images were very clear and no fogging was observed;

○: Images were slightly blurred and slight fogging was observed, but there was no difficulty in practical application;

Δ: Images were blurred or fogging was observed and the images were rather unclear; and x: Fogging or offset was severe and images were quite unclear and hence practically unacceptable.

In the following Tables, "Quality of Image ①" and "Quality of Image ②" mean the result obtained by examining the 100th copy at which the copying apparatus stabilizes and the result obtained by examining the 100,000th copy in order to examine the stability of the quality of the image, respectively.

(5) Blocking: An amount of 100 g of each toner to be examined was charged in a polymer bottle, then subjected to tapping, allowed to stand at 50° C. for 50 hours, then the temperature thereof was brought back to room temperature, the toner was placed on paraffin paper and visually examined to perform evaluation on the basis of the following criteria:

⊙: No blocking was observed;

○: Slight blocking was observed, but there was no difficulty in practical application;

Δ: Severe blocking was observed;

x: Very severe blocking was caused and the resulting copies were almost adhered to form a mass.

(6) Contamination of Photo-sensitive Material and Fixing Roll: A number of 100,000 copies were prepared, at this stage, the photo-sensitive material and the fixing rolls were wiped with cotton cloth and the contamination of the cotton cloth was visually observed. Thus, the contamination of the photosensitive material and the fixing rolls was estimated in terms of the contamination of the cotton cloth which was evaluated on the basis of the following criteria:

⊙: No contamination was observed;

○: The cotton cloth was slightly blackened;

Δ: The cotton cloth was substantially blackened;

x: The cotton cloth became deep-black.

1. Toner compositions in Which the binder resin comprises styrene resin and a block copolymer:

EXAMPLES 1 TO 12 AND COMPARATIVE EXAMPLE 1

Effect of the Styrene Content in Block Copolymer

There were dissolved, in 100 parts of toluene, 100 parts of the foregoing styrene resin A and 5 parts of each of the foregoing block copolymers a to 1 and the solvent was removed by heating at 180° C. and 20 mm Hg to give a resin mixture. Toners were prepared from these resin mixtures in the following manner.

An amount of 100 parts of each of the foregoing resin mixture, 10 parts of carbon black (MA-100; available from Mitsubishi Chemical Industries, Ltd.) and a nigrosine dye as an agent for adjusting electrification were subjected to premixing with a Henschel mixer, kneaded at a set temperature of 170° C. with a twin screw extruder, cooled, roughly pulverized and classified by a classifying machine to give a toner having a particle size ranging from 8 to 20μ. Moreover, the toner was finely pulverized prior to the classification and the rate of particles (% by weight) having a particle size of 1μ or smaller present in the finely pulverized product was determined.

The properties of the resulting toners such as fixing ability, offset properties and quality of images were evaluated. The results thus obtained are listed in the following Table 2.

EXAMPLES 13 TO 18 AND COMPARATIVE EXAMPLES 2 TO 3

Effect of the Amount of Block Copolymer Used

To 100 parts of toluene, there were dissolved 100 parts of the foregoing styrene resin A and the block copolymer d in each amount listed in the following Table 3 and then the solvent was removed by heating at 180° C. and 20 mm Hg to give a resin mixture. Using the resulting resin mixtures, the same procedures used in Examples 1 to 12 were repeated to give each corresponding toner and the properties thereof were evaluated according to the methods as detailed above. The results thus obtained are summarized in Table 3.

EXAMPLES 19 TO 22 AND COMPARATIVE EXAMPLES 4 TO 7

Effect of the Kinds of Styrene Resins Used

To 100 parts of toluene, there were dissolved 100 parts of each of the foregoing styrene resins B, C, D and E and 5 parts of the block copolymer d and then the solvent was removed by heating at 180° C. and 20 mm Hg to give each corresponding resin mixture. In this respect, the resin mixtures for Examples 21 and 22 each was prepared by dissolving 5 parts of the block copolymer d in the xylol solution obtained after the polymerization of the styrene resin A or B and then removing the solvent by heating at 180° C. and 20 mm Hg. Using these resin mixtures, the same procedures used in Examples 1 to 12 were repeated to give each corresponding toner and the properties thereof were evaluated according to the methods as detailed above. The results thus obtained are summarized in Table 4.

EXAMPLES 23 TO 28 AND COMPARATIVE EXAMPLES 8 TO 13

Effect of the Kinds of Block Copolymers Used

These Examples were performed for examining the effect of the kinds of the block copolymers used on the properties of the resulting toner. To 100 parts of toluene, there were added 100 parts of the foregoing styrene resin A and 5 parts of each of various kinds of block copolymers as listed in the following Table 5 and then the solvent was removed by heating at 180° C. and 20 mm Hg to give each corresponding resin mixture. In this respect, the resin mixtures of Comparative Examples 6 to 10 were prepared from the same commercially available block copolymers as those used in Examples 23 to 27 in the same method used above except that the dissolution process and the process for removing solvent were omitted and that the block copolymer was subjected to premixing together with other ingredients with a Henschel mixer. Further the resin mixtures of Comparative Example 11 and Example 28 each was prepared in the same manner using the block copolymer d. Using these resin mixtures, the same procedures used in Examples 1 to 12 were repeated to give each corresponding toner and the properties thereof were evaluated according to the methods as detailed above. The results thus obtained are summarized in Table 5.

EXAMPLES 29-1 TO 29-5 AND COMPARATIVE EXAMPLES 14-1 TO 14-5

Reproducibility

These Examples and Comparative Examples were performed for investigating the reproducibility of the method for the toner production. To this end, the procedures of Example 4 were repeated 5 times while in Comparative Example 14, 100 parts of the foregoing styrene resin A, 10 parts of carbon black (MA-100), 5 parts of low molecular weight polypropylene wax and one part of a nigrosine dye were added to methyl isobutyl ketone as a solvent and the resulting mixture was treated according to spray-drying method to give a toner. Comparative Example 14 was also repeated 5 times. The properties of these toners were evaluated according to the methods as detailed above. The results thus obtained are summarized in Table 6.

2. Toners in which the binder resin comprises a styrene resin and a block copolymer and a low molecular weight wax is simultaneously used:

EXAMPLES 30 TO 31

Influence of the Time of Low Molecular Weight Wax-Addition on Properties of Toner To 100 parts of toluene, there were added 100 parts of the foregoing styrene resin A, 5 parts of the block copolymer d and 5 parts of a low molecular weight polypropylene wax (P 300 having a softening point of 152° C.; available from Mitsui Petrochemical Industries, Ltd.) to form a solution and then the solvent was removed at 180° and 20 mm Hg to give a resin mixture.

After subjecting, to premixing, 100 parts of the foregoing resin mixture, 10 parts of carbon black (MA-100; available from Mitsubishi Chemical Industries Ltd.) and one part of a nigrosine dye as a charge control agent with a Henschel mixer, the resulting mixture was kneaded in a twin screw extruder at a set temperature of 170° C., cooled, roughly pulverized, then finely pulverized and further classified with a classifying machine to give a toner having a particle size ranging from 8 to 20μ (Example 30).

Separately, a resin mixture was prepared by dissolving 100 parts of the foregoing styrene resin A and 5 parts of the block copolymer d in a solvent and then removing the solvent, without using 5 parts of the foregoing low molecular weight polypropylene wax. A toner having a particle size ranging from 8 to 20μ was then prepared in the same method after subjecting, to premixing, 100 parts of the resulting resin mixture, 5 parts of a low molecular weight polypropylene wax, 10 parts of carbon black (MA-100; available from Mitsubishi Chemical Industries Ltd.) and one part of a nigrosine dye as a charge control agent with a Henschel mixer (Example 31).

The properties of the resulting toners such as fixing ability, offset properties and quality of images were likewise evaluated. The results thus obtained are listed in Table 7.

The results listed in Table 7 clearly indicate that the effect achieved by the low molecular weight wax was not affected by the difference in the time of wax-addition.

EXAMPLES 32 TO 43 AND COMPARATIVE EXAMPLE 15

Effect of the Styrene Moiety in Block Copolymer

There were dissolved, in 100 parts of toluene, 100 parts of the foregoing styrene resin A and 5 parts of each of the block copolymers a to 1 and then the solvent was removed by heating at 180° C. and 20 mm Hg to thus give each corresponding resin mixture.

After premixing 100 parts of each resulting resin mixture, 10 parts of carbon black (MA-100; available from Mitsubishi Chemical Industries Ltd.), 5 parts of a low molecular weight polypropylene wax (P 300 having a softening point of 152° C.; available from Mitsui Petrochemical Industries, Ltd.) and one part of a nigrosine dye as a charge control agent with a Henschel mixer, the resulting mixture was kneaded in a twin screw extruder at a set temperature of 170° C., cooled, roughly pulverized, then finely pulverized and further classified with a classifying machine to give a toner having a particle size ranging from 8 to 20μ.

The properties of the resulting toners such as fixing ability, offset properties and quality of images were likewise evaluated. The results thus obtained are listed in Table 8.

EXAMPLES 44 TO 49 AND COMPARATIVE EXAMPLES 16 TO 17

Effect of the Amount of Block Copolymer

There were dissolved, in 100 parts of toluene, 100 parts of the foregoing styrene resin A and the block copolymer d in an amount listed in the following Table 9 and the solvent was removed at 180° C. and 20 mm Hg to give each resin mixture. Toners were prepared from these resin mixtures in the foregoing method and the properties thereof were evaluated by the method detailed above. The results thus obtained are listed in Table 9.

EXAMPLES 50 TO 56 AND COMPARATIVE EXAMPLES 18 TO 20

Effect of the Amount of Low Molecular Weight Wax

There were dissolved, in 100 parts of toluene, 100 parts of the foregoing styrene resin and 5 parts of the block copolymer d and then the solvent was removed at 180° C. and 20 mm Hg to give a resin mixture. According to the foregoing method for preparing toner, toners were prepared except that the resin mixture obtained above was used and that a low molecular weight polypropylene wax (P 300 having a softening point of 152° C.; available from Mitsui Petrochemical Industries, Ltd.) was used in an amount listed in the following Table 10 and the properties of the resulting toners were evaluated according to the methods defined above. In Example 56, the toner was prepared according to the method described above except that 5 parts of a low molecular weight polyethylene wax (210 P having a softening point of 120° C.; available from Mitsui Petrochemical Industries, Ltd.) was used as the low molecular weight wax component. The results obtained are summarized in Table 10.

EXAMPLES 57 TO 60 AND COMPARATIVE EXAMPLES 21, 22

Effect of the Kinds of Styrene Resins Used

There were dissolved, in 100 parts of toluene, 100 parts of the foregoing styrene resin B or C and 5 parts of the block copolymer d and the solvent was removed by heating at 180° C. and 20 mm Hg to give a resin mixture. In Examples 59 and 60, 5 parts of the block copolymer d was dissolved in the xylol solution obtained after polymerization of the styrene resin A or B and then the solvent was removed at 180° C. and 20 mm Hg to give each corresponding resin mixture. According to the foregoing method for preparing toner, toners were prepared from these resin mixtures thus obtained and the properties of the resulting toners were evaluated according to the methods defined above. The results obtained are summarized in the following Table 11.

EXAMPLES 61 TO 66 AND COMPARATIVE EXAMPLES 23 TO 28

Effect of the Kinds of Block Copolymers Used

There were dissolved, in 100 parts of toluene, 100 parts of the foregoing styrene resin A and 5 parts of each commercially available block copolymer listed in the following Table 12 and then the solvent was removed at 180° C. and 20 mm Hg to give each corresponding resin mixture. The resin mixtures of Comparative Examples 23 to 27 were prepared from the same commercially available block copolymers as those used in Examples 61 to 65 according to the same method used above except that the processes for dissolution and for removing the solvent were omitted and that the block copolymer in the form of powder was subjected to premixing together with other ingredients in a Henschel mixer. Further, the resin mixtures of Comparative Example 28 and Example 66 were prepared from the block copolymer d in the same manner used above. According to the foregoing method for preparing toner, toners were prepared from these resin mixtures thus obtained and the properties of the resulting toners were evaluated according to the methods defined above. The results obtained are summarized in the following Table 12.

TABLE 2

| Ex. No. | Block Copolymer No. | 70% Fixing Temp. (°C.) | Offset Temp. (°C.) | Quality of Image 1 | Quality of Image 2 | Blocking | Rate of Particles[1] (ϕ ≦ 1 μ); wt % | Contamination[2] |
|---|---|---|---|---|---|---|---|---|
| | | Effect of the Styrene Moiety in the Block Copolymer | | | | | | |
| 1* | — | 165 | 190 | ○ | X | ○ | 20.5 | Δ |
| 1 | a | 150 | 220 | ○ | ○ | ◎ | 2.1 | ○ |
| 2 | b | 150 | 220 | ◎ | ◎ | ◎ | 3.5 | ◎ |
| 3 | c | 150 | 220 | ◎ | ◎ | ◎ | 2.2 | ◎ |
| 4 | d | 150 | 220 | ◎ | ◎ | ◎ | 2.8 | ◎ |
| 5 | e | 150 | 220 | ◎ | ◎ | ◎ | 3.4 | ◎ |
| 6 | f | 150 | 205 | ○ | ○ | ◎ | 4.6 | ◎ |
| 7 | g | 150 | 220 | ○ | ○ | ◎ | 2.8 | ◎ |
| 8 | h | 150 | 220 | ○ | ◎ | ◎ | 5.9 | ◎ |
| 9 | i | 150 | 220 | ◎ | ◎ | ◎ | 3.4 | ◎ |
| 10 | j | 150 | 220 | ◎ | ◎ | ◎ | 4.6 | ◎ |
| 11 | k | 150 | 220 | ◎ | ◎ | ◎ | 3.8 | ◎ |
| 12 | l | 150 | 220 | ◎ | ○ | ◎ | 2.9 | ◎ |

*Comparative Example;
[1]Rate of particles having a particle size of 1μ or smaller observed after the pulverization;
[2]Contamination of fixing roll and photo-sensitive material.

TABLE 3

| Ex. No. | Amount of Block copolymer d | 70% Fixing Temp. (°C.) | Offset Temp. (°C.) | Quality of Image 1 | Quality of Image 2 | Blocking | Rate of Particles[1] (ϕ ≦ 1μ); wt % | Contamination[2] |
|---|---|---|---|---|---|---|---|---|
| | | Effect of the Amount of the Block Copolymer | | | | | | |
| 2* | 0.05 | 150 | 220 | Δ | X | ◎ | 9.5 | X |
| 13 | 0.1 | 150 | 220 | ◎ | ○ | ◎ | 4.1 | ○ |
| 14 | 1.0 | 150 | 220 | ◎ | ◎ | ◎ | 2.9 | ◎ |
| 15 | 5.0 | 150 | 220 | ◎ | ◎ | ◎ | 2.8 | ◎ |
| 16 | 10.0 | 145 | 220 | ◎ | ◎ | ◎ | 1.8 | ◎ |
| 17 | 15.0 | 140 | 220 | ◎ | ○ | ◎ | 0.9 | ○ |
| 18 | 20.0 | 135 | 220 | ○ | ○ | ○ | 0.6 | ○ |
| 3* | 22.0 | 135 | 220 | ○ | X | X | 0.3 | X |

*Comparative Example;
[1]Rate of particles having a particle size of 1μ or smaller observed after the pulverization;
[2]Contamination of fixing roll and photo-sensitive material.

TABLE 4

| Ex. No. | Resin Used | Kind of Block copolymer | 70% Fixing Temp. (°C.) | Offset Temp. (°C.) | Quality of Image 1 | Quality of Image 2 | Blocking | Rate of Particles[1] (ϕ ≦ 1μ); wt % | Contamination[2] |
|---|---|---|---|---|---|---|---|---|---|
| | | | Effect of the Kinds of the Styrene Resins Used | | | | | | |
| 4* | B | — | 165 | 190 | ○ | X | ○ | 20.5 | X |
| 5* | C | — | 165 | 185 | ○ | X | ◎ | 18.5 | X |
| 19 | B | d | 145 | 215 | ◎ | ◎ | ◎ | 2.9 | ○ |
| 20 | C | d | 150 | 220 | ◎ | ◎ | ◎ | 3.9 | ◎ |
| 21 | A | d | 150 | 220 | ◎ | ◎ | ◎ | 2.2 | ◎ |
| 22 | B | d | 150 | 220 | ◎ | ◎ | ◎ | 2.8 | ◎ |
| 6* | D | d | 175 | 180 | ○ | X | ○ | 6.9 | X |
| 7* | E | d | 165 | 220 | ○ | X | ○ | 1.0 | ○ |

*Comparative Example;
[1]Rate of particles having a particle size of 1μ or smaller observed after the pulverization;
[2]Contamination of fixing roll and photo-sensitive material.

TABLE 5

| Ex. No. | Commercially Available Block Copolymer (Kind) | 70% Fixing Temp. (°C.) | Offset Temp. (°C.) | Quality of Image 1 | Quality of Image 2 | Blocking | Rate of Particles[1] (ϕ ≦ 1μ); wt % | Contamination[2] |
|---|---|---|---|---|---|---|---|---|
| | | Effect of the Kinds of the Block Copolymers used | | | | | | |
| 23 | Cariflex TR 1101 | 150 | 220 | ◎ | ◎ | ◎ | 1.5 | ◎ |
| 24 | Cariflex TR 1112 | 150 | 220 | ◎ | ◎ | ◎ | 1.9 | ◎ |
| 25 | Kraton G 1650 | 150 | 220 | ◎ | ◎ | ◎ | 1.9 | ◎ |

TABLE 5-continued

| Ex. No. | Commercially Available Block Copolymer (Kind) | 70% Fixing Temp. (°C.) | Offset Temp. (°C.) | Quality of Image 1 | Quality of Image 2 | Blocking | Rate of Particles[1] (ϕ ≦ 1μ); wt % | Contamination[2] |
|---|---|---|---|---|---|---|---|---|
| | | Effect of the Kinds of the Block Copolymers used | | | | | | |
| 26 | Septon KL-1001 | 155 | 220 | ◎ | ◎ | ◎ | 1.2 | ◎ |
| 27 | Tufprene A | 150 | 220 | ◎ | ◎ | ◎ | 2.0 | ◎ |
| 28 | d | 150 | 220 | ◎ | ◎ | ◎ | 2.8 | ◎ |
| 8* | Cariflex TR 1101 | 150 | 220 | ○ | Δ | ◎ | 6.2 | ○ |
| 9* | Cariflex TR 1112 | 150 | 220 | ○ | X | ◎ | 6.3 | Δ |
| 10* | Kraton G 1650 | 150 | 220 | ○ | Δ | ◎ | 7.2 | Δ |
| 11* | Septon KL-1001 | 155 | 220 | ○ | Δ | ◎ | 5.1 | Δ |
| 12* | Tufprene A | 150 | 220 | ○ | X | ◎ | 5.7 | ○ |
| 13* | d | 150 | 220 | ○ | ○ | ◎ | 5.5 | Δ |

*Comparative Example;
[1]Rate of particles having a particle size of 1μ or smaller observed after the pulverization;
[2]Contamination of roll and photo-sensitive material.

TABLE 6

| Ex. No. | Number of Repetition | 70% Fixing Temp. (°C.) | Offset Temp. (°C.) | Quality of Image 1 | Quality of Image 2 | Blocking | Rate of Particles[1] (ϕ ≦ 1μ); wt % | Contamination[2] |
|---|---|---|---|---|---|---|---|---|
| | | | | Reproducibility | | | | |
| 29-1 | 1 | 150 | 220 | ◎ | ◎ | ◎ | 2.8 | ◎ |
| 29-2 | 2 | 150 | 220 | ◎ | ◎ | ○ | 1.5 | ○ |
| 29-3 | 3 | 145 | 220 | ◎ | ◎ | ◎ | 1.5 | ◎ |
| 29-4 | 4 | 150 | 220 | ◎ | ◎ | ◎ | 2.2 | ◎ |
| 29-5 | 5 | 155 | 220 | ◎ | ◎ | ◎ | 2.0 | ◎ |
| 14-1* | 1 | 165 | 200 | ◎ | ○ | ◎ | 3.4 | Δ |
| 14-2* | 2 | 175 | 220 | ○ | ○ | ◎ | 1.6 | X |
| 14-3* | 3 | 150 | 195 | ○ | X | ◎ | 7.8 | Δ |
| 14-4* | 4 | 160 | 220 | Δ | X | ◎ | 0.9 | ◎ |
| 14-5* | 5 | 155 | 220 | ◎ | ◎ | ◎ | 2.0 | X |

*Comparative Example;
[1]Rate of particles having a particle size of 1μ or smaller observed after the pulverization;
[2]Contamination of fixing roll and photo-sensitive material.

TABLE 7

| Ex. No. | Time of Addition of Low Molecular Weight Wax | 70% Fixing Temp. (°C) | Higher Offset Temp. (°C.) | Quality of Image 1 | Quality of Image 2 | Blocking |
|---|---|---|---|---|---|---|
| | | Effect of the Time of Addition of the Low Molecular Weight Wax | | | | |
| 30 | During Removal of Solvent | 150 | 220 | ◎ | ◎ | ◎ |
| 31 | During Kneading | 150 | 220 | ◎ | ◎ | ◎ |

TABLE 8

| Ex. No. | Amount of Styrene resin A Used | Number of Block Copolymer Used | 70% Fixing Temp. (°C.) | Higher Offset Temp. (°C.) | Quality of Image 1 | Quality of Image 2 | Blocking |
|---|---|---|---|---|---|---|---|
| | | Effect of the Styrene Moiety in the Block Copolymer | | | | | |
| 15* | 100 | — | 165 | 190 | ○ | X | ○ |
| 32 | 100 | a | 150 | 205 | ○ | ○ | ◎ |
| 33 | 100 | b | 150 | 220 | ◎ | ◎ | ◎ |
| 34 | 100 | c | 150 | 220 | ◎ | ◎ | ◎ |
| 35 | 100 | d | 150 | 220 | ◎ | ◎ | ◎ |
| 36 | 100 | e | 150 | 220 | ◎ | ◎ | ◎ |
| 37 | 100 | f | 150 | 205 | ○ | ○ | ◎ |
| 38 | 100 | g | 150 | 200 | ○ | ○ | ◎ |
| 39 | 100 | h | 150 | 215 | ○ | ◎ | ◎ |
| 40 | 100 | i | 150 | 220 | ◎ | ◎ | ◎ |
| 41 | 100 | j | 150 | 220 | ◎ | ◎ | ◎ |
| 42 | 100 | k | 150 | 220 | ◎ | ◎ | ◎ |

TABLE 8-continued

| Effect of the Styrene Moiety in the Block Copolymer | | | | | | | |
|---|---|---|---|---|---|---|---|
| Ex. No. | Amount of Styrene resin A Used | Number of Block Copolymer Used | 70% Fixing Temp. (°C.) | Higher Offset Temp. (°C.) | Quality of Image 1 | Quality of Image 2 | Blocking |
| 43 | 100 | 1 | 150 | 200 | ◎ | ○ | ◎ |

*Comparative Example

TABLE 9

| Effect of the Amount of the Block Copolymer Used | | | | | | | |
|---|---|---|---|---|---|---|---|
| Ex. No. | Amount of Styrene resin A Used | Number of Block Copolymer d Used | 70% Fixing Temp. (°C.) | Higher Offset Temp. (°C.) | Quality of Image 1 | Quality of Image 2 | Blocking |
| 16* | 100 | 0.05 | 150 | 175 | X | X | ◎ |
| 44 | 100 | 0.1 | 150 | 205 | ○ | ○ | ◎ |
| 45 | 100 | 1.0 | 150 | 220 | ◎ | ◎ | ◎ |
| 46 | 100 | 5.0 | 150 | 220 | ◎ | ◎ | ◎ |
| 47 | 100 | 10.0 | 150 | 220 | ◎ | ◎ | ◎ |
| 48 | 100 | 15.0 | 150 | 220 | ◎ | ○ | ◎ |
| 49 | 100 | 20.0 | 150 | 220 | ○ | ○ | ○ |
| 17* | 100 | 22.0 | 150 | 220 | X | X | X |

*Comparative Example

TABLE 10

| Effect of the Amount of the Low Molecular Weight Wax Used | | | | | | | | |
|---|---|---|---|---|---|---|---|---|
| Ex. No. | Amount of Styrene Resin A | Amount of L.M.W Polypropylene | 70% Fixing Temp. (°C.) | Higher Offset Temp (°C.) | Quality of (°C.) 1 | Quality of Image 2 | Blocking | Offset Temp. (°C.) |
| 18* | 100 | 0 | 150 | 140 | ◎ | ◎ | ◎ | 220 |
| 19* | 100 | 0.3 | 150 | 150 | ◎ | ◎ | ◎ | 220 |
| 50 | 100 | 0.5 | 150 | 195 | ◎ | ◎ | ◎ | 220 |
| 51 | 100 | 1.0 | 150 | 220 | ◎ | ◎ | ◎ | 220 |
| 52 | 100 | 5.0 | 150 | 220 | ◎ | ◎ | ◎ | 220 |
| 53 | 100 | 10.0 | 150 | 220 | ◎ | ◎ | ◎ | 220 |
| 54 | 100 | 15.0 | 155 | 220 | ◎ | ○ | ○ | 220 |
| 55 | 100 | 20.0 | 160 | 220 | ○ | ○ | ○ | 220 |
| 56 | 100 | 5 | 150 | 220 | ◎ | ◎ | ◎ | 220 |
| 20* | 100 | 22.0 | 190 | 220 | X | X | Δ | 220 |

*Comparative Example

TABLE 11

| Effect of the Kinds of the Styrene Resins Used | | | | | | | |
|---|---|---|---|---|---|---|---|
| Ex. No. | Kind of Styrene resin Used | Kind of Block Copolymer Used | 70% Fixing Temp. (°C.) | Higher Offset Temp. (°C.) | Quality of Image 1 | Quality of Image 2 | Blocking |
| 21* | B | — | 165 | 190 | ○ | X | ○ |
| 22* | C | — | 160 | 185 | ○ | X | ◎ |
| 57 | B | d | 150 | 220 | ◎ | ◎ | ◎ |
| 58 | C | d | 150 | 220 | ◎ | ◎ | ◎ |
| 59 | A | d | 150 | 220 | ◎ | ◎ | ◎ |
| 60 | B | d | 150 | 220 | ◎ | ◎ | ◎ |

*Comparative Example

TABLE 12

| Effect of the Kinds of the Block Copolymers Used | | | | | | | |
|---|---|---|---|---|---|---|---|
| Ex. No. | Amount of Styrene Resin | Kind of Commercially Available Block Copolymer Used | 70% Fixing Temp. (°C.) | Higher Offset Temp. °C.) | Quality of Image 1 | Quality of Image 2 | Blocking |
| 61 | 100 | Cariflex TR 1101 | 145 | 220 | ◎ | ◎ | ◎ |

TABLE 12-continued

Effect of the Kinds of the Block Copolymers Used

| Ex. No. | Amount of Styrene Resin | Kind of Commercially Available Block Copolymer Used | 70% Fixing Temp. (°C.) | Higher Offset Temp. °C.) | Quality of Image 1 | Quality of Image 2 | Blocking |
|---|---|---|---|---|---|---|---|
| 62 | 100 | Cariflex TR 1112 | 150 | 220 | ◎ | ◎ | ◎ |
| 63 | 100 | Kraton G 1650 | 150 | 220 | ◎ | ◎ | ◎ |
| 64 | 100 | Septon KL-1001 | 150 | 220 | ◎ | ◎ | ◎ |
| 65 | 100 | Tufprene A | 140 | 220 | ◎ | ◎ | ◎ |
| 66 | 100 | d | 150 | 220 | ◎ | ◎ | ◎ |
| 23* | 100 | Cariflex TR 1101 | 145 | 195 | Δ | Δ | ◎ |
| 24* | 100 | Cariflex TR 1112 | 150 | 200 | ○ | Δ | ◎ |
| 25* | 100 | Kraton G 1650 | 150 | 205 | ◎ | Δ | ○ |
| 26* | 100 | Septon KL-1001 | 150 | 200 | ○ | Δ | ○ |
| 27* | 100 | Tufprene A | 140 | 190 | ○ | X | ○ |
| 28* | 100 | d | 150 | 200 | ○ | Δ | ◎ |

*Comparative Example

What is claimed is:

1. A heat-fixable toner composition for electrophotography which comprises a binder and a coloring material wherein the binder comprises a resin mixture prepared by heating at a temperature ranging from 100° C. to 250° C. a resin solution comprising (i) a styrene resin having a weight-average molecular weight ranging from 10,000 to 300,000, (ii) a block copolymer and/or a hydrogenated product thereof containing a styrene moiety in the block copolymer in an amount ranging from 5 to 70% by weight and (iii) at least one solvent therefor selected from the group consisting of toluene, xylene, ethylbenzene, mineral spirit, n-butyl alcohol, iso-butyl alcohol, amyl alcohol, cyclohexyl alcohol, methylisobutyl alcohol, cyclohexanone and butyl acetate and removing said solvent wherein the block copolymer comprises at least one block of styrene and at least one kind of block selected from ethylenic hydrocarbons and conjugated diene hydrocarbons and wherein the block copolymer is in an amount ranging from 0.1 to 20 parts by weight per 100 parts by weight of the styrene resin.

2. The heat fixable toner composition according to claim 1 wherein the solvent is selected from the group consisting of benzene, toluene, xylene and ethylbenzene.

3. The toner composition for electrophotography according to claim 1 wherein the amount of the block copolymer and/or the hydrogenated product thereof used ranges from 0.1 to 10 parts by weight per 100 parts by weight of the styrene resin.

4. A heat-fixable toner composition for electrophotography which comprises a binder, a coloring material and a low molecular weight wax in an amount ranging from 0.5 to 20 parts by weight per 100 parts by weight of the binder wherein the binder comprises a resin mixture prepared by heating at a temperature ranging from 100° C. to 250° C. a resin solution comprising (i) a styrene resin having a weight-average molecular weight ranging from 10,000 to 300,000, (ii) a block copolymer and/or a hydrogenated product thereof containing a styrene moiety in the block copolymer in an amount ranging from 5 to 70% by weight and (iii) at least one solvent therefor selected from the group consisting of toluene, xylene, ethylbenzene, mineral spirit, n-butyl alcohol, iso-butyl alcohol, amyl alcohol, cyclohexyl alcohol, methylisobutyl alcohol, cyclohexanone and butyl acetate and removing said solvent wherein the block copolymer comprises at least one block of styrene and at least one kind of block selected from ethylenic hydrocarbons and conjugated diene hydrocarbons and wherein the block copolymer is in an amount ranging from 0.1 to 20 parts by weight per 100 parts by weight of the styrene resin.

5. The heat fixable toner composition according to claim 4 wherein the solvent is selected from the group consisting of benzene, toluene, xylene and ethylbenzene.

6. The toner composition for electrophotography according to claim 4 wherein the amount of the block copolymer and/or the hydrogenated product thereof used ranges from 0.1 to 10 parts by weight per 100 parts by weight of the styrene resin.

7. The toner composition for electrophotography according to claim 4 wherein the low molecular weight wax is a polyolefin having a softening point ranging from 60° to 180° C.

8. The toner composition for electrophotography according to claim 4 wherein the amount of the low molecular weight wax used ranges from 0.5 to 10 parts by weight per 100 parts by weight of the binder.

9. A heat-fixable toner composition for electrophotography which comprises a binder and a coloring material wherein the binder comprises a resin mixture prepared by heating at a temperature ranging from 100° C. to 250° C. a resin solution comprising (i) a styrene resin having a weight-average molecular weight ranging from 10,000 to 300,000, (ii) a block copolymer and/or a hydrogenated product thereof containing a styrene moiety in the block copolymer in an amount ranging from 5 to 70% by weight, (iii) at least one solvent therefor selected from the group consisting of toluene, xylene, ethylbenzene, mineral spirit, n-butyl alcohol, iso-butyl alcohol, amyl alcohol, cyclohexyl alcohol, methylisobutyl alcohol, cyclohexanone and butyl acetate and (iv) a low molecular weight wax and removing said solvent wherein the block copolymer comprises at least one block of styrene and at least one kind of block selected from ethylenic hydrocarbons and conjugate diene hydrocarbons and wherein the block copolymer is in an amount ranging from 0.1 to 20 parts by weight per 100 parts by weight of the styrene resin and the low molecular weight wax is in an amount ranging from 0.5 to 2 parts by weight per 100 parts by weight of the binder.

10. The heat fixable toner composition according to claim 9 wherein the solvent is selected from the group consisting of benzene, toluene, xylene and ethylbenzene.

11. The toner composition for electrophotography according to claim 9 wherein the amount of the block copolymer and/or the hydrogenated product thereof used ranges from 0.1 to 10 parts by weight per 100 parts by weight of the styrene resin.

12. The toner composition for electrophotography according to claim 9 wherein the low molecular weight wax is a polyolefin having a softening point ranging from 60° to 180° C.

13. The toner composition for electrophotography according to claim 9 wherein the amount of the low molecular weight wax used ranges from 0.5 to 10 parts by weight per 100 parts by weight of the binder.

* * * * *